US006729748B2

(12) United States Patent
Reilly

(10) Patent No.: US 6,729,748 B2
(45) Date of Patent: May 4, 2004

(54) INTERNALLY ILLUMINATED CANDLE

(76) Inventor: Kevin Reilly, 369 S. Hopper St., Montgomery, AL (US) 36107

( * ) Notice: Subject to any disclaimer, the term of this patent is extended or adjusted under 35 U.S.C. 154(b) by 15 days.

(21) Appl. No.: 10/150,131

(22) Filed: May 16, 2002

(65) Prior Publication Data

US 2003/0214813 A1 Nov. 20, 2003

(51) Int. Cl.[7] ..... F21V 21/00; F21V 35/00; F21P 1/02

(52) U.S. Cl. ..... 362/392; 362/287; 362/410; 362/411; 362/413; 362/414; 362/418; 362/431; 313/315

(58) Field of Search ..... 362/392, 287, 362/414; 313/315

(56) References Cited

U.S. PATENT DOCUMENTS 1,725,048 A * 8/1929 Black ..... 313/315
1,736,820 A * 11/1929 Black ..... 313/315
3,684,882 A 8/1972 Mininno
3,753,643 A 8/1973 Golden
3,761,702 A 9/1973 Andeweg
3,762,857 A 10/1973 Andeweg
4,477,249 A 10/1984 Ruzek et al.
4,567,548 A 1/1986 Schneeberger
4,739,457 A * 4/1988 Orr ..... 362/287
4,839,784 A 6/1989 Lin
5,664,879 A 9/1997 Lai
5,791,774 A 8/1998 Briles
5,951,153 A * 9/1999 Favela ..... 362/414

* cited by examiner

*Primary Examiner*—Sandra O'Shea
*Assistant Examiner*—James W Cranson, Jr.
(74) *Attorney, Agent, or Firm*—Goldman IP Law

(57) ABSTRACT

An electric lighting device which simulates the look of a wax candle. The device includes a body formed of relatively high melting temperature candle wax. A longitudinal channel runs between a top portion and a bottom portion of the body. In the bottom portion radial channels provided between the longitudinal channel and the circumferentional surface of the body. These channels provide ventilation to the candle body when the lighting device is in operation. A fix unit is also provided which has openings adapted to a line with the channels in the body so that air circulation is maintained when the candle body is placed in the base unit.

17 Claims, 6 Drawing Sheets

INTERNALLY ILLUMINATED CANDLE

FIELD OF THE INVENTION

The present invention relates to a lighting device and more particularly an electrical lighting device which in appearance is similar to a wax candle.

DESCRIPTION OF THE PRIOR ART

Lighting devices which simulate the appearance of wax candles are in relatively wide use. Typically, the body of a candle is simulated by a structural formed of a material which will not melt in the presence of heat such as that which is generated by an electric light bulb. A flame type bulb may typically be disposed above the simulated candle body. In order to better simulate a real candle, it would also be desirable to have an electrical light device in which the candle body was formed of candle wax. It would also be desirable for the electric light bulb of the lighting device to be disposed within at least a portion of this wax candle body to enable the light from the bulb to be distributed through the candle body. These features, while desirable, are difficult to implement, however, because the heat generated by an electric light bulb would tend to melt a wax candle body.

In accordance with the present invention, therefore, an electrical lighting device which includes a candle body formed of wax with a relatively high melting temperature. The body has a longitudinal channel through its center connecting to one or more radial 1 channels in a bottom portion of the body. These radial channels may be aligned with respective openings in a corresponding candle base unit to enable ventilation of the candle body. An electric light bulb may be positioned in a widened opening near the top of the candle body. A bulb-socket supported by a rigid tube which may be connected to the candle base unit. Optionally, one or more spacers which provide minimal obstruction to the airflow through the longitudinal channel may support the rigid tube within the longitudinal channel. When the light bulb is on, air circulation is provided via the radial and longitudinal channels in the candle body to cool the candle body to a temperature below its melting point.

It is an object of the invention therefore to provide an electrical light fixture which used a candle body to simulate the look of wax candles.

It is a further object of the invention to provide ventilation for the wax body of the lighting device which is sufficient to prevent the body from melting when the light bulb is on.

It is a further object of the invention to provide a base unit for the device which supports the body and provides for ventilation of the body.

These and further objects and advantages of the present invention will become apparent from the following detailed description and the accompanying drawings in which:

DETAILED DESCRIPTION OF THE INVENTION

Figure 1:
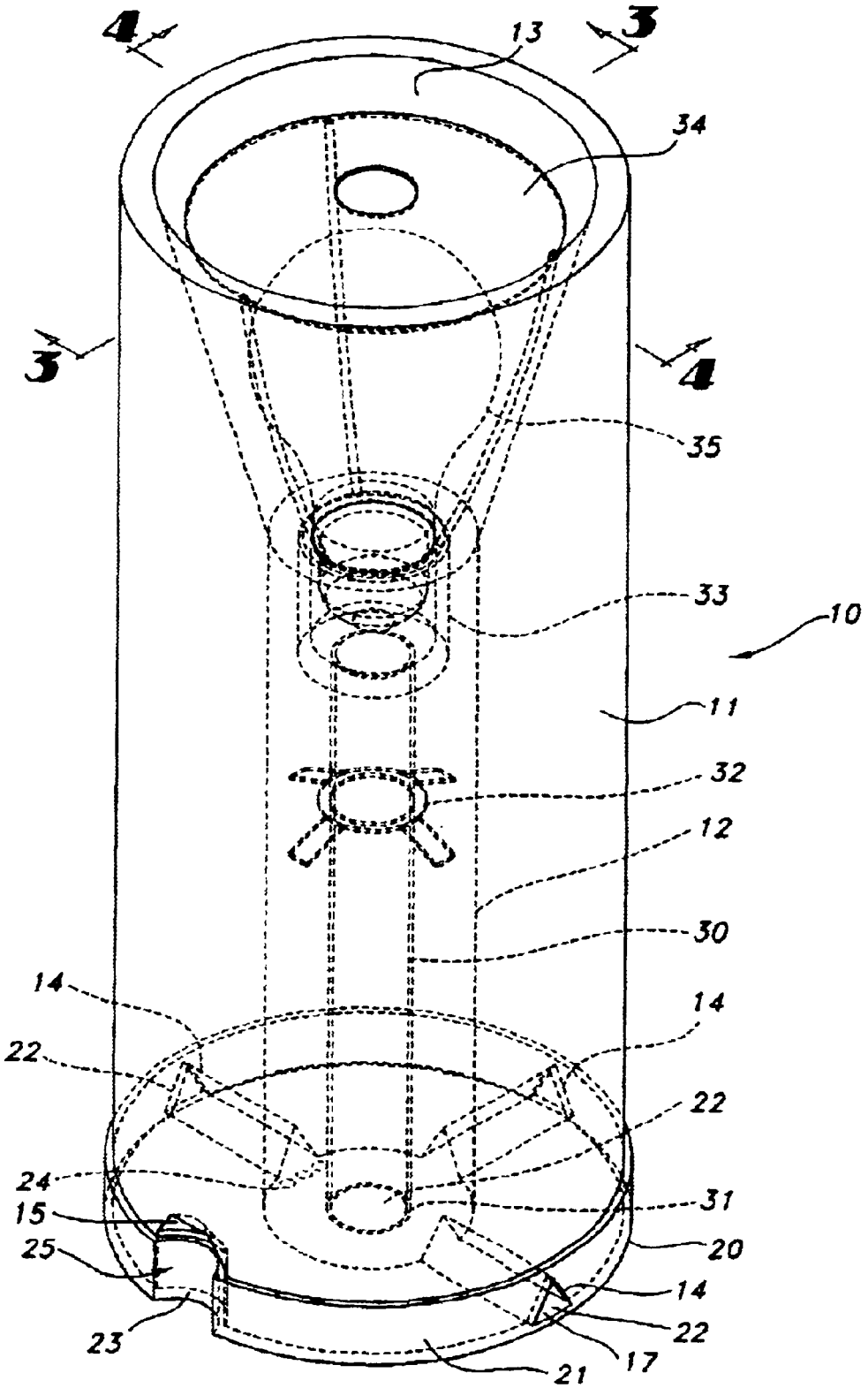
FIG. 1 is a perspective view of a lighting device in accordance with the invention.

FIG. 1 illustrates the lighting device 10 of the present invention. A candle body 11 of the invention is formed of a candle wax having a relatively high melting point (e.g. at least 165° F. and preferably 175° F.). The candle body 11 is formed with a longitudinal or axial channel 12 through it. At the top of the candle body, the longitudinal channel 12 opens into a widened top opening 13 which, may have a frusto-conical shape as illustrated in FIG. 1 or any other convenient shape (See e.g. FIG. 6). The candle body 11 may be appropriately molded to form the longitudinal channel 12 and widened opening 13, or the channel 12 and opening 13 may be formed in the body 11 by drilling, countersinking or similar means. In a bottom portion of the candle body 11 one or more radial channels 14 are formed. Each of the radial channels 14 open into the longitudinal channel 12.

The lighting device of the present invention preferably includes a base unit 20 to hold the candle body 11 in an upright position. This base unit 20 includes a sleeve 21 and a floor 26. The sleeve portion has openings 22 formed in it which correspond in size and shape to the radial channels 14 of the candle body 11. When the candle body 11 is assembled with the base unit 20 the radial channels 14 should be aligned with corresponding sleeve openings 22 thereby providing unimpeded air circulation through channels 11 and 14. In order to ensure this alignment of the channels 14 and sleeve openings 22, alignment means are provided which, in the embodiment of FIG. 1 comprises a protrusion 23 in the sleeve 21 which corresponds to a complimentary shaped notch 15 formed in the candle body 11. This notch 15 is positioned relative to the radial channels 22 in a manner such that when the notch 15 is properly aligned with the protrusion 23 the radial channels 14 will be in alignment with the sleeve openings 22.

In an alternative embodiment (not shown), the floor in 26 of the base unit 20 may be stamped or otherwise formed with ridges generally corresponding in shape and relative positioning to the radial channels 14 of the candle body. These ridges may serve as the means for aligning the candle body with the base unit 26 while at the same time providing sufficient air flow between the sleeve openings 22 and the longitudinal channel 12 of the candle body 11.

Additional airflow for the purposes of cooling the candle body may be provided, for example, by openings 24 in the base unit floor. These openings should be positioned to align with the bottom opening of the longitudinal channel 12 in the candle body 11.

To complete the lighting device of the present invention, a light bulb socket 33 may be supported by a rigid tube 30 affixed to the base unit floor. Additional support for the rigid tube 30 may be provided one or more spacers 32 which should be formed to provide minimum obstruction to air flow through the longitudinal channel 12. A suitable light bulb 35 may be placed within the light bulb socket 33.

Further insulation of the candle body 11 from heat generated by the bulb 35 may be optionally provided by a shade 50.

Figure 2:
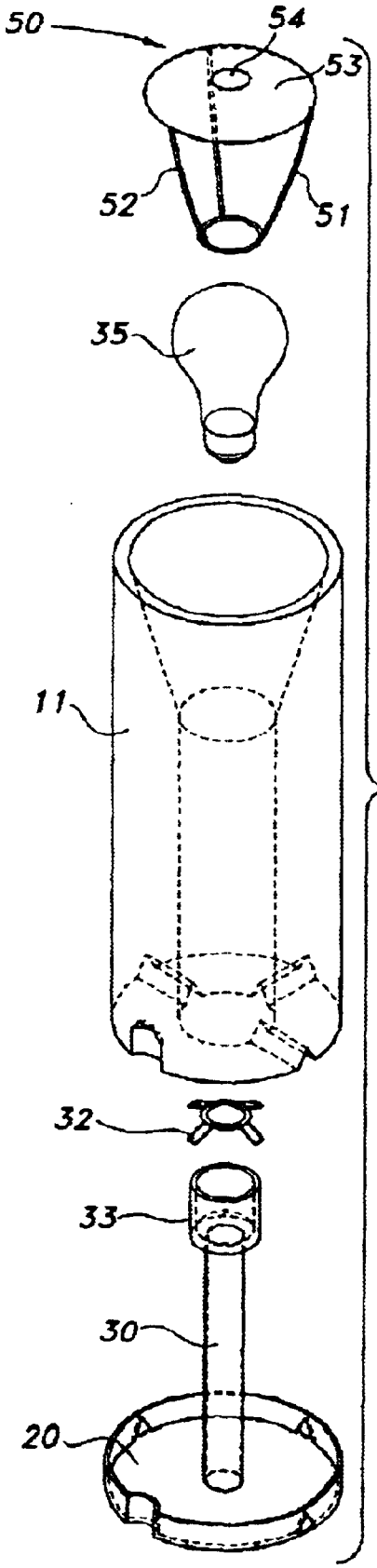
FIG. 2 is an exploded view of the embodiment of the invention illustrated in FIG. 1.

FIG. 2 is an exploded embodiment of the invention set forth in FIG. 1 showing details of the connections between the base unit floor 20, rigid tubing 30, light fixture 33, spacer 32, and candle body 11. FIG. 2 also shows some further detail of the lamp shade 50 which may include a frame 51, a side shade portion 52 and, optionally, top shade portion 53. If a top shade portion 53 is utilized, care should be taken to provide proper ventilation such as by a opening 54 in the top shade portion 53.

Figure 3:
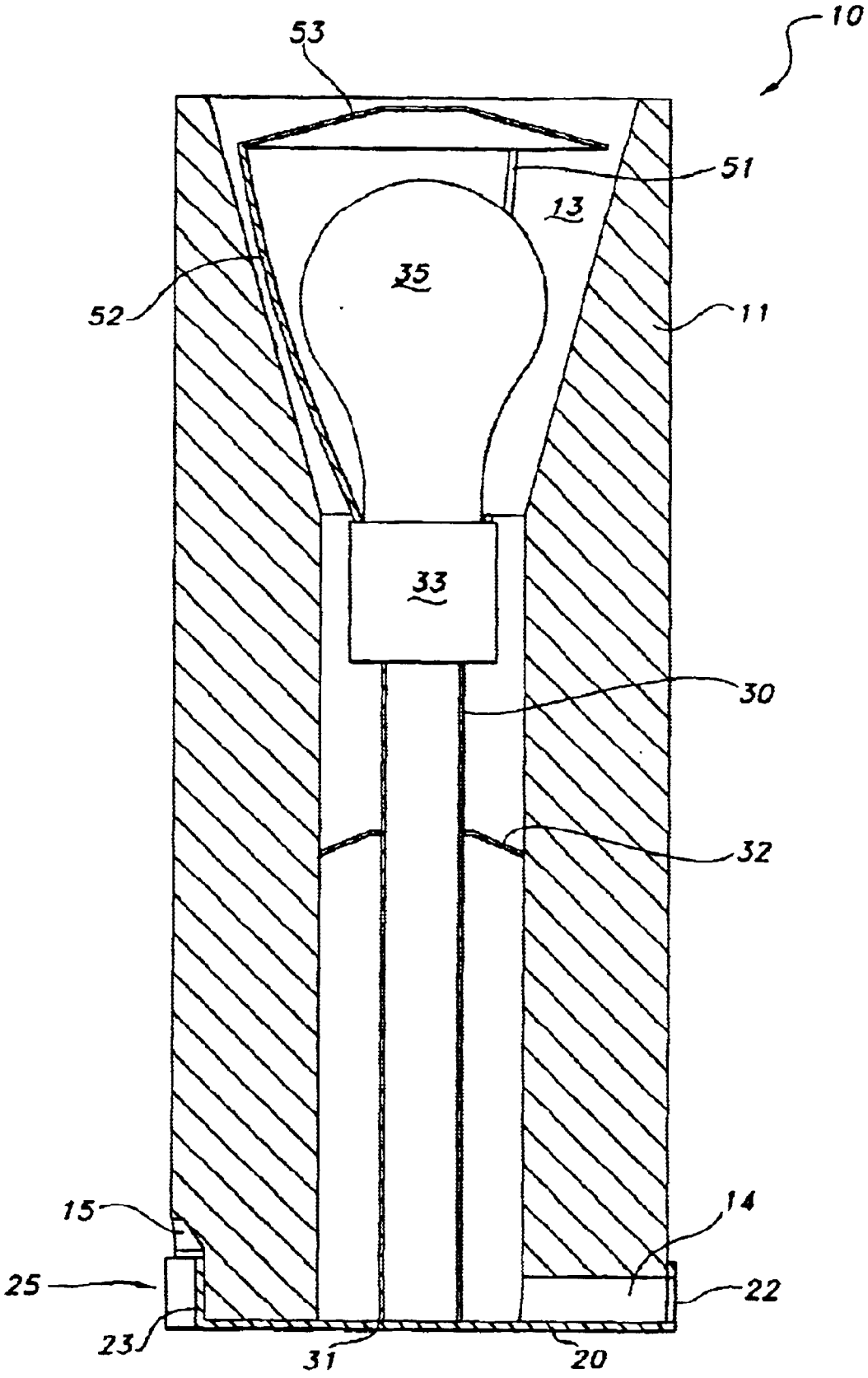
FIG. 3 is a sectional view of the invention illustrated in FIG. 1 along the lines 3—3.
Figure 4:
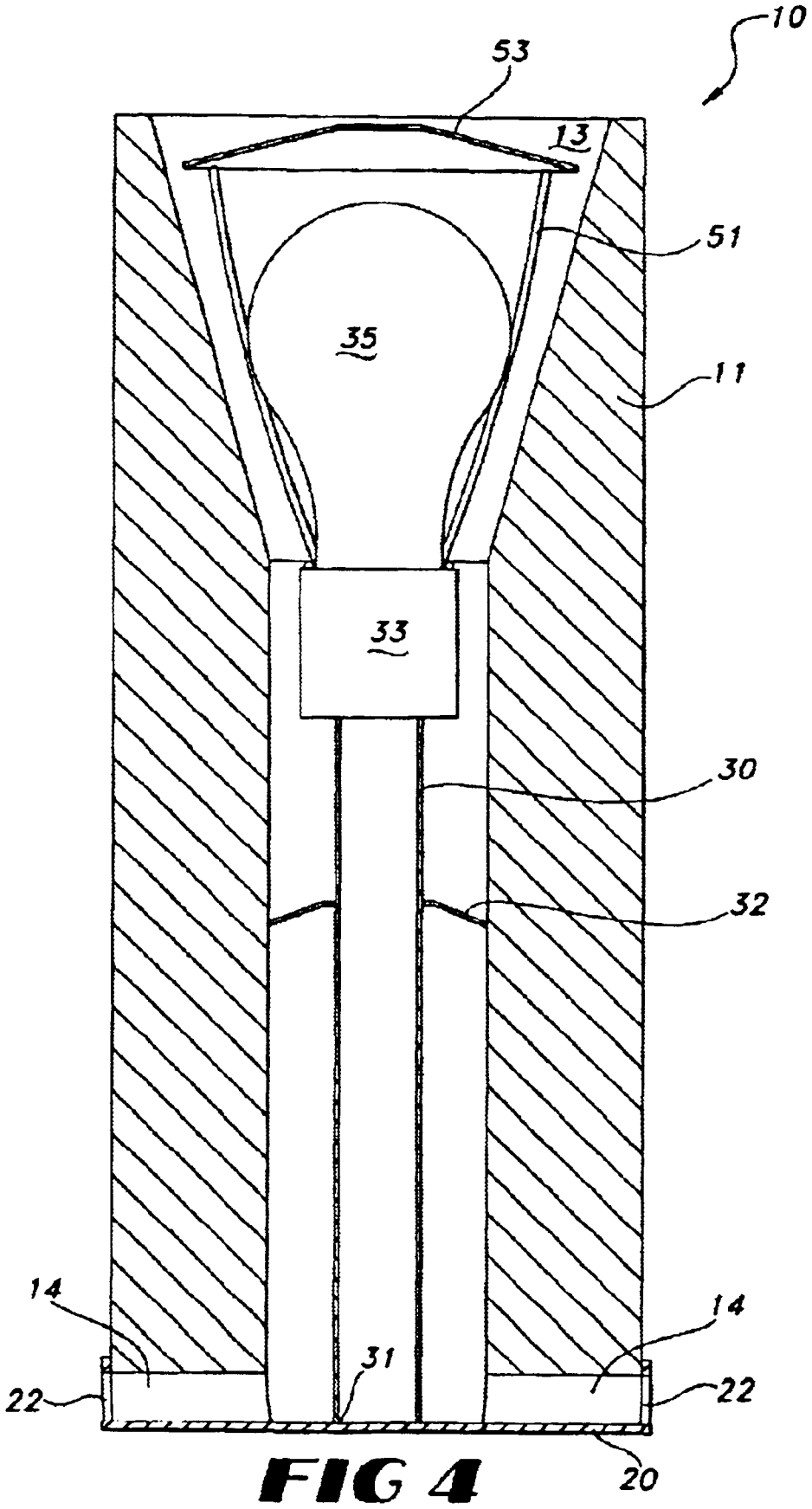
FIG. 4 is a sectional view of the invention of FIG. 1 cut along the line 4—4.

FIGS. 3 and 4 show some further details of the interconnection and preferred alignments between the candle body 11, rigid tubing 30, the spacer 32, and the base unit 26 of the embodiment invention illustrated in FIGS. 1 and 2. FIG. 3 also shows a cut away view of the relationship between the notch 15 and the candle body 11 to the protrusion 25 in the base unit to provide alignment between the sleeve opening 22 and the radial channels 14 of the candle body 11.

Figure 5:
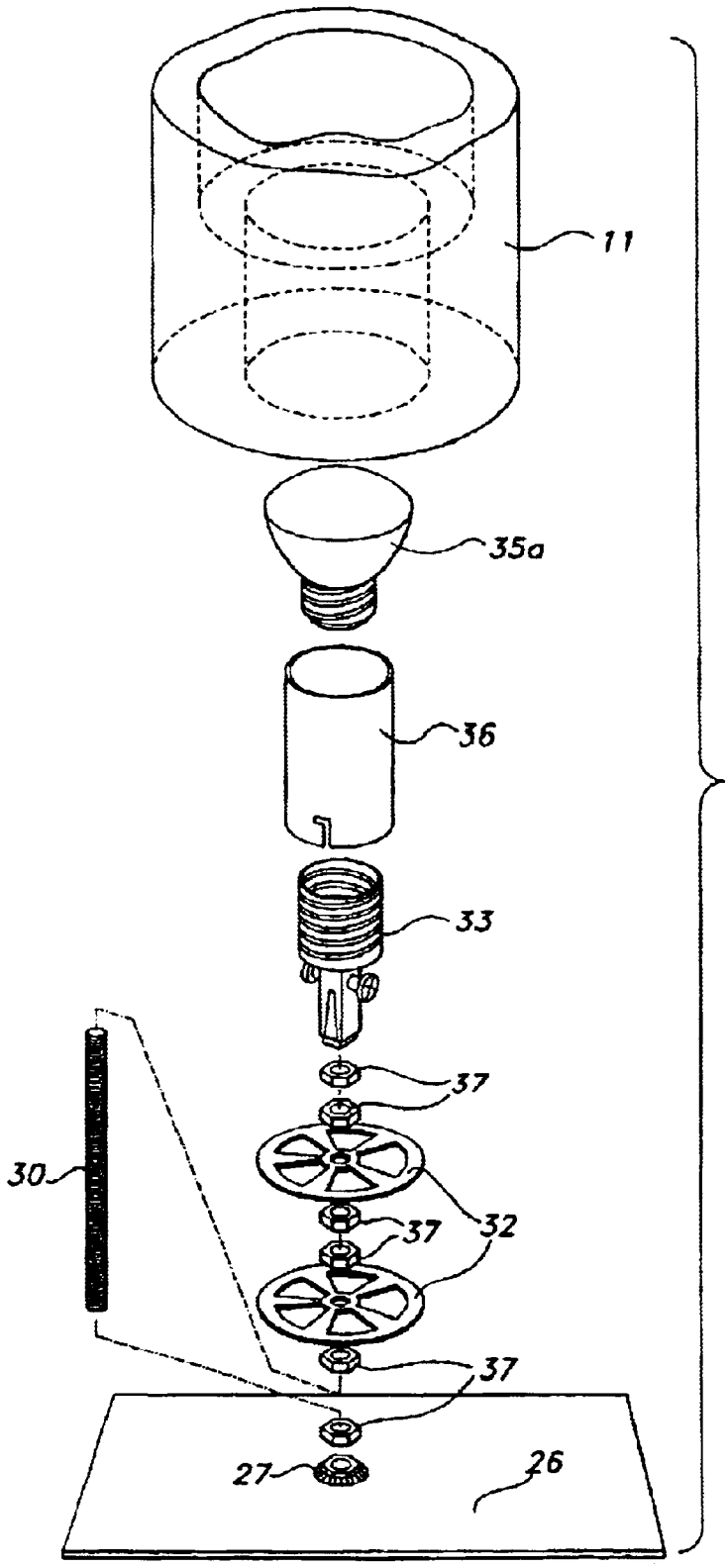
FIG. 5 is an exploded view of a presently preferred embodiment of the invention.

FIG. 5 shows details of an alternative and presently preferred embodiment of the invention. As shown in FIG. 5, the rigid tubing 30 is affixed to the base unit floor 26 by a means of a welded threaded nut 27 and nuts 37. Threaded nuts 37 are also used to hold spacers 32 in place along the length of the rigid tube 30. In the present embodiment the rigid tube 30 may be a standard threaded tube to which a light bulb socket 33 with a sleeve 36 may be attached. In the preferred Also, a reflective type bulb 35A is shown in this embodiment. It will be appreciated, however, that any type of light bulb may be utilized in accordance with the present invention. Electricity is provided to the light bulb socket 33 via a wire 38 which may be tied to the rigid tubing 30 by suitable fasteners 39 and routed through an opening in the floor 26 of the base unit.

Figure 6:
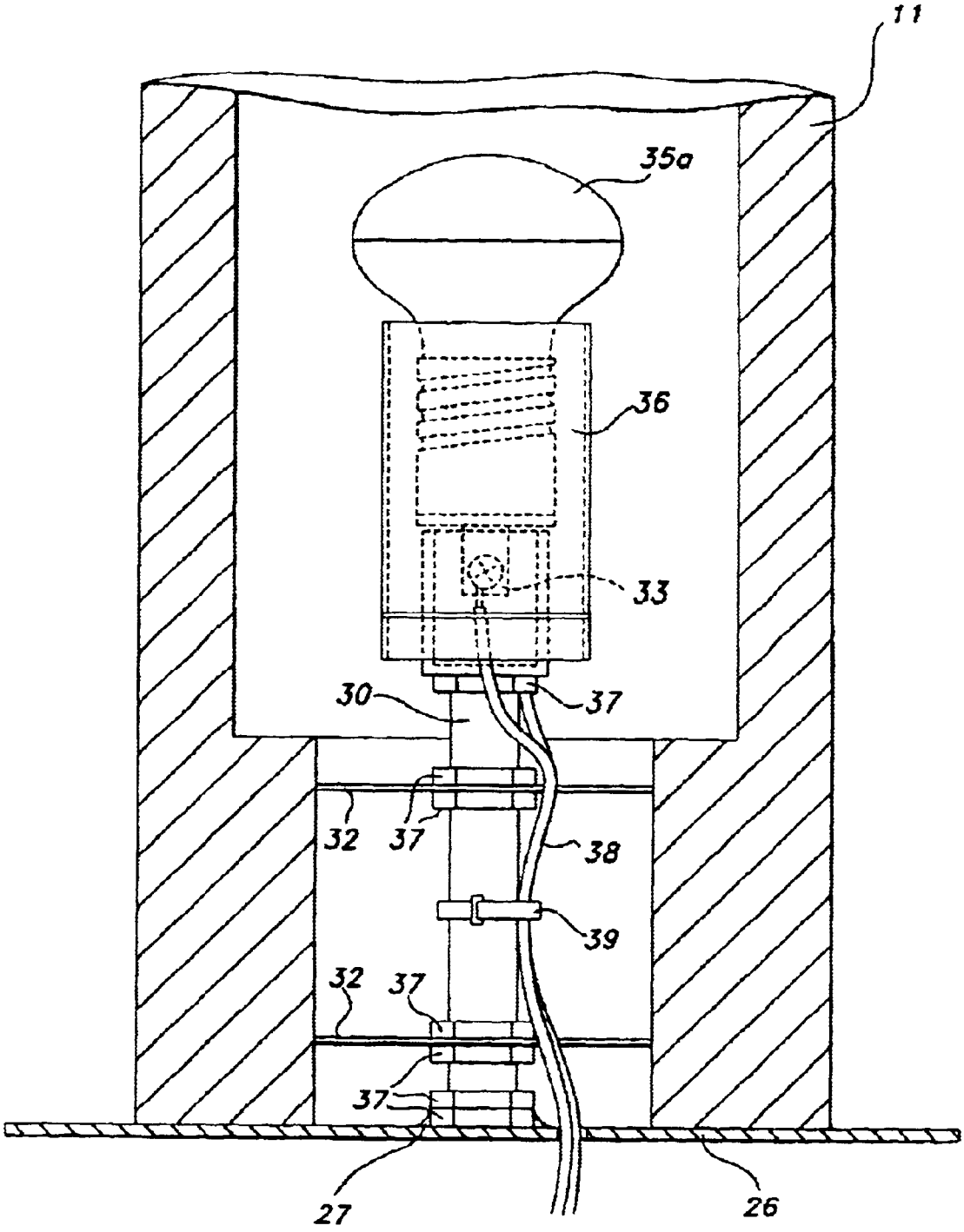
FIG. 6 is a plan view of the embodiment of the invention illustrated in FIG. 5.

Referring to FIG. 6, there is an exploded version of the presently preferred embodiment. The light bulb used in this embodiment is a 25 watt type R14 reflective-bulb 35A. The spacers 32 formed of nylon with openings formed therein for ventilation. The rigid tube 30 is a one-eight inch 27 B.S.S. threaded lighting tube.

In operation, heat generated by the light bulb 35 or 35*a* causes air within the widened opening 13 of the candle body 11 to rise. This, in turn draws cool air into the widened opening 13 via the longitudinal channel 12 and radial channels 22. Optionally, additional cooling air may be supplied to the longitudinal channel 12 via the opening 24 in the base unit 26. The cooling effect of this air circulation, coupled with the relatively high melting point of the candle wax employed in the candle body 11 serve to prevent melting of the candle body 11 by heat generated by the light bulb 35 or 35*a*.

What is claimed is:

1. A decorative component for an electrical lighting device comprising:

a candle body formed of candle wax having a top portion, a bottom portion, and a longitudinal ventilation channel formed therein between said top end portion said bottom portion;

said longitudinal ventilation channel opening into a widened opening at the top portion of said body said widened opening being of a size sufficient to enclose the electrical lighting device within said body;

said longitudinal ventilation channel opening into at least one radial ventilation channel in said bottom portion of said body;

each said radial ventilation channel opening into a circumferentional portion of said body; and each said radial ventilation channel and said longitudinal ventilation channel being of sufficient cross sectional area as to prevent melting of the candle body by heat from the electrical lighting device.

2. The decorative component of claim 1 wherein the candle wax has a melting temperature of at least 165° F.

3. The decorative component of claim 1 further comprising a base unit adopted to accept the body therein and including, an opening therein adapted to be aligned with a corresponding circumferential opening of one said redial channel in said candle body.

4. The decorative component of claim 3 further including means for aligning said base unit opening with said corresponding radial channel opening of said body.

5. The decorative component of claim 4 wherein said means for aligning includes a notch in a bottom portion of said body and a corresponding protrusion in said base unit.

6. The decorative component of claim 1 further compromising:

means for supporting an electrical light fixture within the widened opening of said longitudinal channel.

7. The decorative component of claim of 6 wherein said supporting means comprises:

a rigid tube; and at least one spacer adapted to position the tube longitudinally and centrally in said longitudinal channel.

8.The decorative component of claim 7 wherein said spacer is formed to allow air circulation therethrough.

9. The decorative device of claim 3 further comprising means for supporting an electric light in said widened opening.

10. The decorative device of claim 9 wherein said supporting means comprises:

a rigid tube; and means in said base unit for supporting said rigid tube centrally and longitudinally in said longitudinal channel of said candle body.

11. A decorative electrical lighting device comprising:

a body formed of candle wax having a top portion, a bottom portion, and a longitudinal channel formed therein between said top end portion said bottom portion;

said longitudinal channel opening into a widened opening at the top portion of said body;

said longitudinal channel opening into at least one radial channel in said bottom portion of said body;

each said radial channel opening into a circumferentional portion of said body; and means for supporting an electrical light fixture within the widened opening of said longitudinal channel.

12. The lighting device of claim 11 wherein the candle wax has a melting temperature of at least 165° F.

13. The lighting device of claim 11 further comprising a base unit adopted to accept the body therein and including, an opening therein adapted to be aligned with a corresponding circumferential opening of one said radial channel in said candle body.

14. The lighting device of claim 13 further including means for aligning said base unit opening with said corresponding radial channel opening of said body.

15. The lighting device of claim 14 wherein said means for aligning includes a notch in a bottom portion of said body and a corresponding protrusion in said base unit.

16. The light device of claim of 11 wherein said supporting means comprises:

a rigid tube; and at least one spacer adapted to position the tube longitudinally and centrally in said longitudinal channel.

17. The lighting device of claim 16 wherein said spacer is formed to allow air circulation therethrough.

* * * * *